United States Patent [19]

Bursk et al.

[11] 4,154,034

[45] May 15, 1979

[54] DOOR FRAME CONSTRUCTION

[75] Inventors: William M. Bursk, Middletown; David H. Pease, Jr., Cincinnati, both of Ohio

[73] Assignee: Pease Company, Fairfield, Ohio

[21] Appl. No.: 532,405

[22] Filed: Dec. 13, 1974

[51] Int. Cl.[2] ..... E06B 1/04

[52] U.S. Cl. ..... 52/213; 49/504; 52/455

[58] Field of Search ..... 52/210–213, 52/455; 49/504, 505

[56] References Cited

U.S. PATENT DOCUMENTS

| | | | |
|---|---|---|---|
| 3,107,759 | 10/1963 | Day et al. | 52/212 |
| 3,226,781 | 1/1966 | Schnabel | 52/213 |
| 3,250,049 | 5/1966 | Sklar | 52/213 X |
| 3,345,780 | 10/1967 | McGhee | 52/211 |
| 3,364,624 | 1/1968 | Davis | 52/213 |
| 3,585,770 | 6/1971 | Maizler | 49/504 |
| 3,721,055 | 3/1973 | Jerchower | 49/504 |
| 3,800,488 | 4/1974 | Swanson | 52/212 |

FOREIGN PATENT DOCUMENTS

| | | | |
|---|---|---|---|
| 600111 | 11/1959 | Italy | 52/211 |

*Primary Examiner*—J. Karl Bell

*Attorney, Agent, or Firm*—Biebel, French & Nauman

[57] ABSTRACT

A door frame construction in which the jambs, threshold, lintel, and trim are of molded construction. The door frame may be molded in one piece and the jambs are provided with clips for attaching the jambs to studs framing the door opening. The clips are adjustably mounted on the jambs so that the door frame may be positioned properly despite misalignment of the studs to which the frame is attached. The jambs also carry clips for attaching the trim to the door frame, and these clips and the clips for mounting the frame on the studs may be formed integrally from a single strip of metal. The side and head trim are preferably formed separately and joined at the job site by means of a special corner construction which allows them to be joined without nails, screws or other external fasteners.

3 Claims, 13 Drawing Figures

10
24
14
2
20
16
18
22
12
2
18
26
28
35
35
28
35
28
26

DOOR FRAME CONSTRUCTION

BACKGROUND OF THE INVENTION

In conventional building construction, door frames are constructed on site with the wooden jambs, threshold and lintel nailed together in place and attached to the studs framing the door opening. The trim members are then nailed in place about the door frame prior to the application of the wall sheathing.

More recently, factory constructed and prehung door frames have been used which can be shipped as a unit to the building site. Door frames constructed in this manner can, of course, be constructed to rather specific tolerances. However, the door frames must be attached to the studding framing the door opening, and the studs are usually not installed with the same degree of accuracy that the prehung door frames are manufactured so that some difficulty may be experienced in mounting a preconstructed door frame in the door opening.

Conventionally, the door trim or brick molding is also constructed on site and the side trim members and the head trim mitered and nailed in place around the door opening. This, of course, is time consuming and requires relatively expensive skilled labor for both constructing and installing the trim.

SUMMARY OF THE INVENTION

The present invention provides a door frame of molded construction which incorporates adjustable clips for attaching the frame to studding at the door opening and molded trim members which are assembled without nails or other separate fasteners and attached to the premolded door frame by spring clips.

The jambs, threshold and lintel making up the door frame may be molded as an integral unit or may be molded separately and joined, preferably in the factory before shipment to the job site except in the cases of exceptionally wide door frames, such as double door frames. In the latter case, convenience in shipping may dictate that the door frame members are assembled at the construction site.

The outer surfaces of the door jambs are provided with clips each of which has one leg projecting outwardly of the door frame and provided with holes for nailing the clips to the door framing studs. A second leg of the clips extends at right angles to the first leg, overlies the outer surface of the jamb on which it is mounted and is slotted to receive a headed bolt extending through the slot and into the jamb. This permits adjustment of the door frame with respect to the studs to which it is attached to accommodate misalignment of the studs.

Preferably the jambs are reenforced by bosses at the points where the clips are attached, and channels are formed in the bosses slidably receiving the slotted legs of the clips. This prevents the clips from being skewed when the bolts securing the clips to the jambs are loosened to permit adjustment.

The openings in the door jambs receiving the bolts for the clips preferably extend completely through the jambs, and the bolts are provided with slots or other tool receiving openings at their ends opposite their heads so that the bolts may be loosened or tightened from either side of the jambs. At the hinge side of the door frame, the bosses are formed conveniently at the hinge locations to provide additional, reenforcing thickness, not only for the clip receiving channels, but for the hinges as well.

The jambs and lintel of the door frame are provided with recessed pockets for receiving weather stripping. The weather stripping at the lintel and lock jambs is preferably of the magnetic type and set well within the pockets within the lintel and lock jamb so that it does not project outwardly when the door is open.

The jambs are also provided with trim clips which can be formed integrally with the stud clips from a single strip of metal. The trim clips have a resilient finger which allows the trim members to be slid in place and held firmly against the jambs. This permits a tight seal to be formed around the door opening despite the fact that there may be some misalignment of the framing at the doorway.

The trim member will generally be formed in separate pieces, including head trim and side trim members. This provides a universal side trim which can be used with various size head trim, ranging from that used with narrow, single doorways to wide, double doorways. Additionally, where side lights are used, the side trim can be positioned on either side of the side lights.

To facilitate assembly of the side and head trim, the side trim, preferably, is provided with resilient fingers which engage within the ends of the head trim so that the three members may be snapped into place at the job site.

While any suitable material may be utilized in molding the door frame members and the trim members, a fiberglass reenforced polystyrene has been found to perform most satisfactorily and permits the various members to be assembled to each other by glueing, screwing or nailing.

DESCRIPTION OF THE PREFERRED EMBODIMENTS

Figures 1, 2:
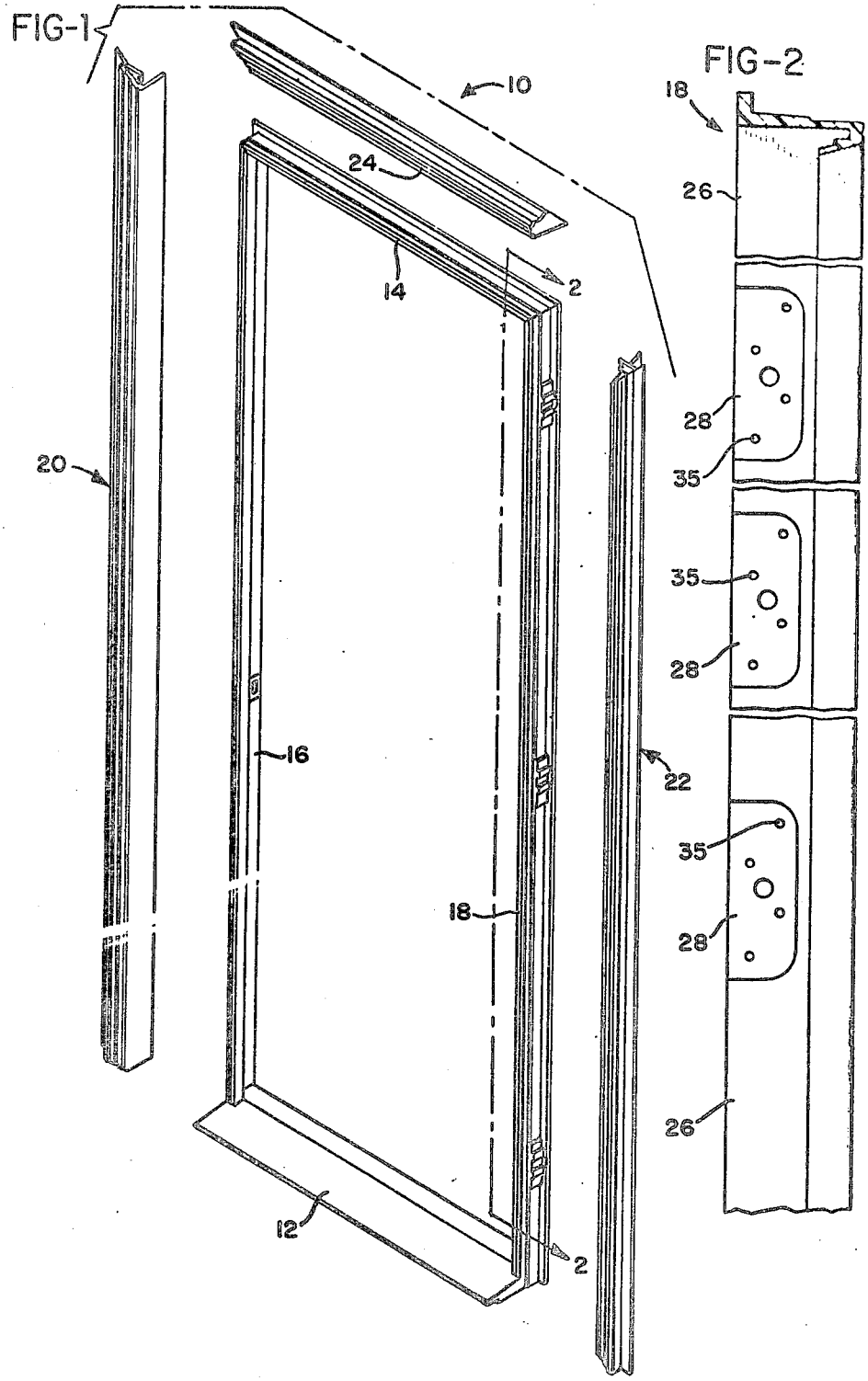
FIG. 1 is an exploded perspective view of a door frame and trim constructed in accordance with the present invention.
FIG. 2 is a view taken on line 2—2 of FIG. 1.

A door frame 10 in accordance with the present invention includes a threshold 12, a lintel 14, a lock side jamb 16 and a hinge side jamb 18. Associated with the door frame 10, in a manner to be described below, is a trim assembly including side trim members 20 and 22 and a head trim member 24.

Figure 6:
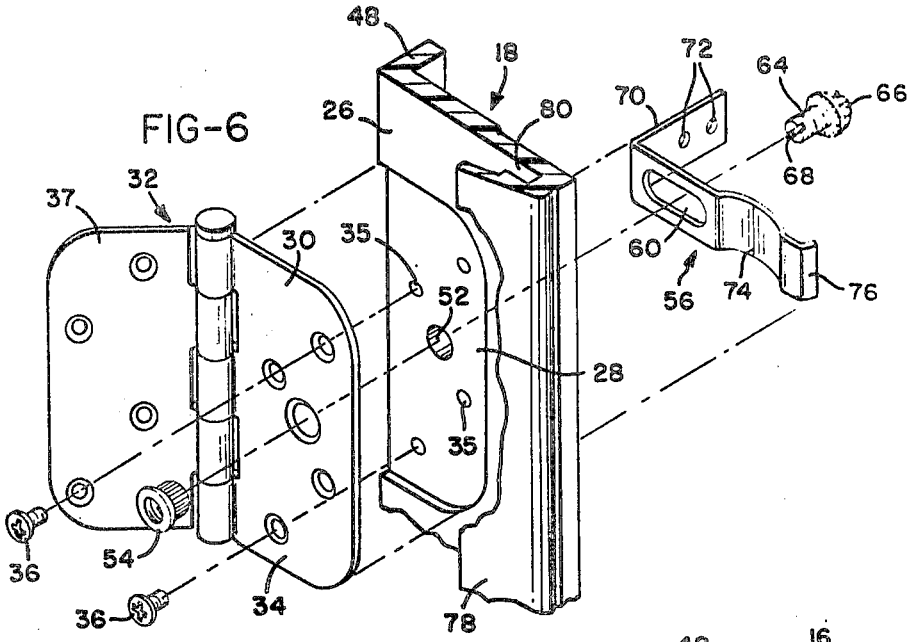
FIG. 6 is an exploded perspective view of a portion of the hinge side jamb, the hinge and a clip associated with the jamb.
Figure 9:
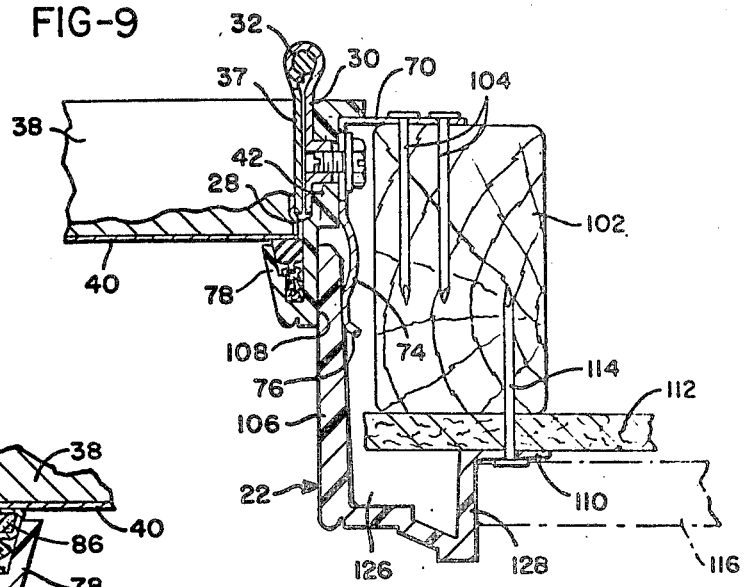
FIG. 9 is a horizontal cross-sectional view through a portion of the door frame, trim and associated structure at the hinge side of the frame.
Figure 10:
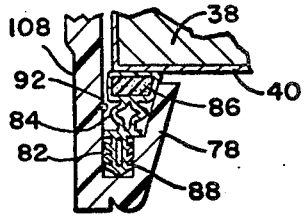
FIG. 10 is an enlarged view of a portion of the lock side jamb showing the weather seal construction.
Figure 11:
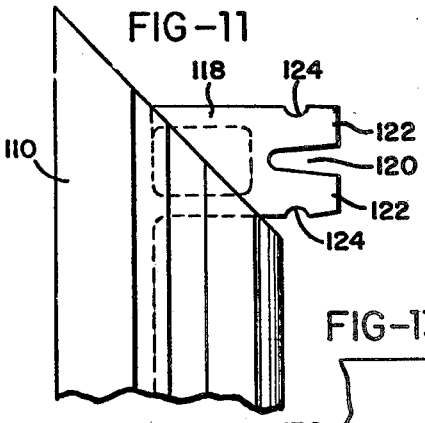
FIG. 11 is an elevational view of the upper end of a side trim member and connector.
Figure 12:
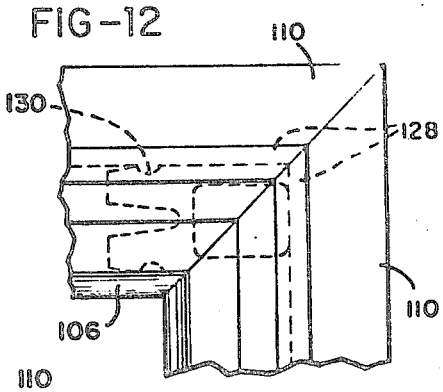
FIG. 12 is an elevational view of a portion of a side and head trim member showing the joint therebetween.
Figure 13:
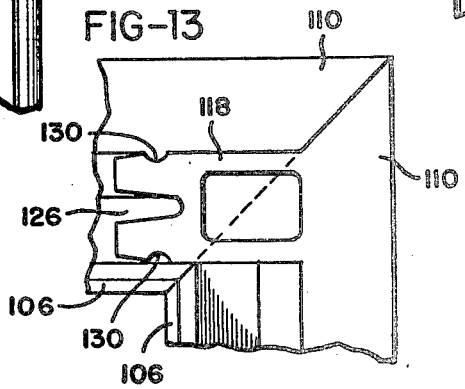
FIG. 13 is a view similar to FIG. 12 but showing a rear side of a joint between a side and head trim member.

As seen in FIGS. 2, 6 and 9 of the drawings, the inner surface 26 of the jamb member 18 is provided with a series of relieved sections 28 adapted to receive one leaf 30 of a hinge 32 with the inner surface 34 of the leaf 30 lying flush with the surface 26 of the jamb 18. Bolt holes 35 are formed in the jamb to permit the leaf 30 to be bolted thereto by means of bolts 36. The other leaf 37 of the hinge 32 is, of course, attached to a door 38 which preferably, in accordance with the present invention, is metal clad, as indicated at 40.

Figure 3:
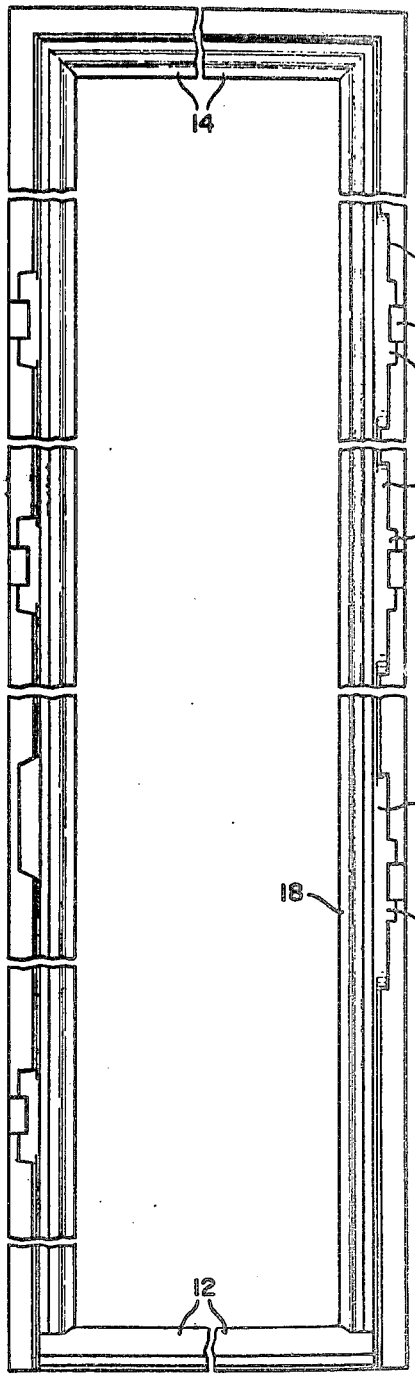
FIG. 3 is an elevational view of the door frame of the present invention.
Figure 5:
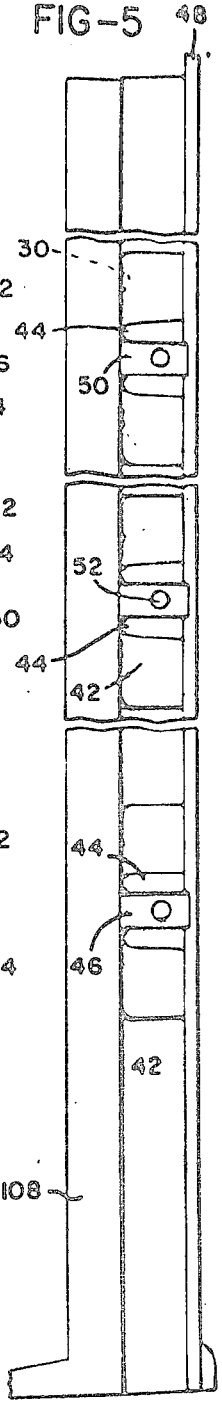
FIG. 5 is an outside view of the hinge side jamb of the door frame.
Figure 7:
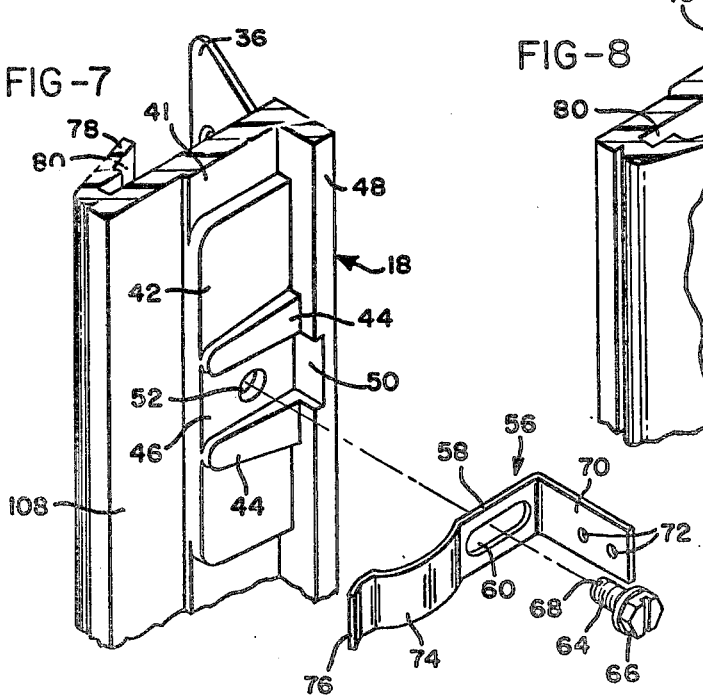
FIG. 7 is an exploded perspective view similar to FIG. 6 but from the opposite or outer side of the jamb.

The outer surface 41 of the jamb 18, opposite the surface to which the hinge 32 is attached, is provided with a series of bosses 42, as also seen in FIGS. 3, 5 and 7 of the drawings. These bosses serve as thickened, reenforcement portions of the jamb 18 to provide anchorage for the bolts 36 securing the hinge 32 to the jamb 18.

Approximately centrally of each boss 42 are a pair of spaced legs 44 which define therebetween a channel 46, and an outwardly directed leg 48 of the jamb 18 is notched at 50 to provide a continuation of the channel 46. An opening 52, somewhat larger than the bolt holes 35, is also formed through each of the bosses 42 to receive an internally threaded, externally knurled bolt anchor 54, as seen in FIG. 6 of the drawings.

A single strip 56 of metal or the like has one leg 58 thereof slotted at 60 to receive a bolt 62 having a threaded shank 64, a slotted head 66 and a slotted end 68 opposite the head thereof. The shank 64 of the bolt is received through the slot 60 and is threaded into the anchor 54. The strip 56 is provided with a second leg 70 extending at approximately right angles to the leg 58 and provided with openings 72 therethrough. A third, curved leg 74 extends from the opposite side of the leg 58 and has an outwardly, reversely bent portion 76 for a purpose presently to be described.

The lock side jamb 16, as best seen in FIGS. 3, 4, 8 and 10 of the drawings, is similar in general cross-sectional configuration to the jamb 18. However, it is unnecessary for the jamb 16 to be provided with bosses as large as the bosses 42 since bosses 90 on the lock jamb 16 need only be large enough to accommodate slots 46 receiving strips 56 of the type shown in FIGS. 6 and 7 of the drawings.

The jamb 16 is also provided with a leg 48 notched at 50 and serving as an elongation of the slot 46 and is provided with openings 52 for receiving internally threaded, externally knurled bolt anchors 54. The jamb 16 is also provided with a leg 78 defining with an inner surface 92 of the jamb a pocket 80 for the reception of a magnetic weather stripping material 82.

With this construction it will be apparent that with the door open, the resilient connection 84 between the magnetic portion 86 and the anchor portion 88 of the weather strip 82 tends to draw the magnetic portion of the weather strip into the pocket 80 when the door is open but allows a tight seal to be made when the door is closed.

Figure 4:
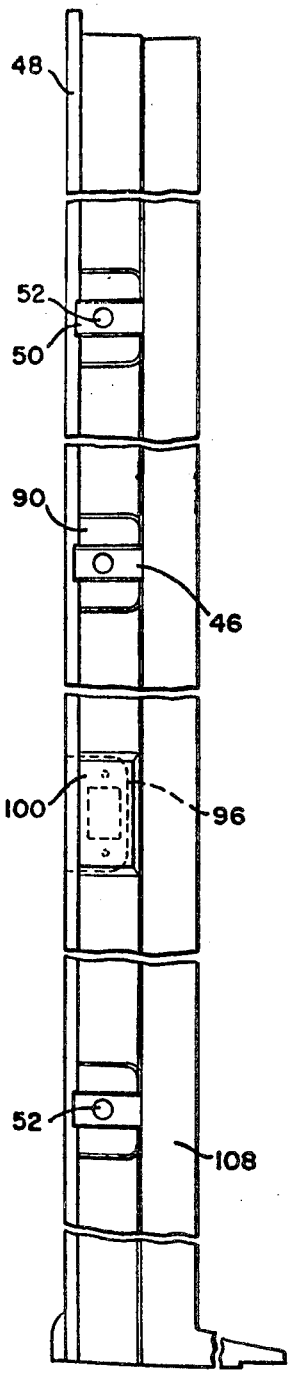
FIG. 4 is a view of the outside of the lock side jamb of the door frame.
Figure 8:
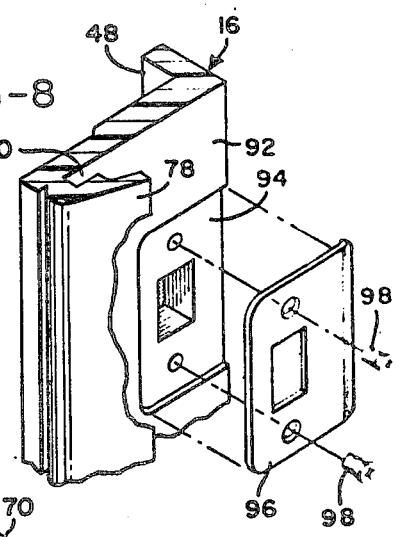
FIG. 8 is an exploded perspective view of a portion of the lock side jamb.

Surface 92 of the jamb 16 is also relieved, as shown at 94 in FIG. 8 of the drawings, to receive a strike plate 96 attached to the jamb by means of bolts 98. To reenforce the jamb at the strike plate, an additional boss 100 is formed on the jamb, as seen in FIGS. 3 and 4 of the drawings.

The jambs 16 and 18 are interconnected adjacent their upper ends by the lintel 14, which is of the same general cross-sectional configuration as the jambs, and by a threshold 12 adjacent their lower ends. The door frame 10 is preferably molded as a one-piece, prehung unit which may then be shipped to the job site and attached to studs, shown at 102 in FIG. 9 of the drawings, by means of nails or the like 104 driven through the openings 72 in the stud clip portion 70 of the strip 56.

In this regard, it will be seen that the slotted opening 60 in the member 56 permits the door frame to be adjusted to accommodate any misalignment of the studs 102. Thus, the bolts 62 are loosened and the frame 10 adjusted as required and the bolts 62 then tightened in place. In this regard, it will be noted that the double slotted construction of the bolts 62 permits the bolt to be loosened or tightened from inside or outside the door frame.

After the door frame has been mounted on the studs 102, the trim members can be attached thereto. The trim comprises, as noted above, side trim members 20 and 22 and a head trim member 24. Trim members 20 and 22 are of substantially identical but reverse construction, and the head trim member 24 is of the same cross-sectional configuration as members 20 and 22.

As best seen in FIGS. 1, 9 and 11 through 13 of the drawings, trim member 22 includes a first leg 106 which is slidably received between an outer surface 108 of the jambs 16 and 18 and the curved leg 74 which constitutes a trim clip.

The reversely curved portion 76 of the leg 74 permits the leg 106 of each of the side trim members to be slipped in place and gripped between the surface 108 and the leg 74 while permitting slidable movement of the trim members relative to their associated jambs. The member 74 thus permits such positioning of the trim member as is nescessary to effect a weather tight seal. An outer leg 110 of the trim member seats on sheathing 112 through which it is nailed by means of nails 114 to the studs 102. Siding 116 may then be applied over the leg 110.

Preferably the trim is formed of separate side and head trim members which are assembled at the job site. This permits universal side trim members to be utilized both adjacent the jambs of the door frame and spaced outwardly from the jambs where side light construction is utilized. Thus, the length of the head trim is selected for a specific job depending on the width of the doorway for which the trim is required, and the height of the side trim can be substantially standardized.

To facilitate the joining of the side and head trim, the upper end of each of the side trim members is provided with a resilient joint member 118 which is slotted at 120 to provide resiliency to the legs 122, and each of the legs 122 is provided with an indent 124. Member 118 is adapted to be received in the channel 126 formed between the legs 106 and 128 of the head trim. It will also be noted from FIGS. 12 and 13 of the drawings that protrusions 130 project inwardly into the channel 126 and snap in place into the indents 124 when the side and end members are joined to secure them to each other.

From the above it will be seen that the present invention provides a door frame of molded construction which can be constructed as a prehung unit in the factory and installed quickly and simply on the job and which incorporates means for adjusting the frame and trim members to accommodate misalignment of the structural members to which they are attached.

While the article herein described constitutes a preferred embodiment of the invention, it is to be understood that the invention is not limited to this precise article, and that changes may be made therein without departing from the scope of the invention.

What is claimed is:

1. A door frame construction comprising:

(a) a pair of spaced, substantially parallel studs, (b) a pair of spaced, substantially parallel jambs extending substantially co-extensively with said studs, (c) a lintel and threshold extending between and joining said jambs adjacent upper and lower ends thereof and forming a unitary door frame, (d) a plurality of clips having first, second and third attaching portions, (e) first attaching means securing first attachment portions of said clips to said jambs, (f) second attaching means securing second attachment portions of said clips to said studs, (g) said clips including means permitting relative adjusting movement between said unitary door frame and said studs to which it is attached to compensate for irregularities in the positioning of said studs, (h) trim members overlying portions of said door frame, and (i) said third portions of said clips attaching said trim members to said jambs.

2. The construction of claim 1 wherein:

(a) said third portions of said clips comprise extensions of said first portions of said clips resiliently engaging said trim members and securing portions of said trim members against outer faces of said jambs.

3. The construction of claim 2 wherein:

(a) said trim members include side trim members extending substantially parallel to said jambs and head trim members extending substantially parallel to said lintel, and (b) resilient means interconnecting said side and head trim members.

* * * * *